US005996803A

United States Patent [19]

Thompson

[11] Patent Number: 5,996,803

[45] Date of Patent: Dec. 7, 1999

[54] INFANT PRODUCTS ORGANIZER

[76] Inventor: Patrick Thompson, 25936 Monte Carlo Way, Mission Viejo, Calif. 92692

[21] Appl. No.: 09/215,616

[22] Filed: Dec. 17, 1998

Related U.S. Application Data

[60] Provisional application No. 60/069,408, Dec. 18, 1997.

[51] Int. Cl.[6] ..... B65D 69/00

[52] U.S. Cl. ..... 206/577; 206/581; 220/527; 220/528

[58] Field of Search ..... 220/527, 528, 220/529, 4.31, 4.33; 206/223, 549, 494, 577, 581, 600; 224/575

[56] References Cited

U.S. PATENT DOCUMENTS

| | | | |
|---|---|---|---|
| 3,401,814 | 9/1968 | Chiswell et al. | 220/4.31 |
| 5,289,941 | 3/1994 | Blankenburg et al. | 220/552 |
| 5,558,242 | 9/1996 | Kuan | 220/4.31 |
| 5,638,973 | 6/1997 | Dewey et al. | 220/4.33 |
| 5,782,360 | 7/1998 | Markson | 206/600 |
| 5,794,782 | 8/1998 | Ascik | 206/600 |

*Primary Examiner*—Paul T. Sewell
*Assistant Examiner*—Nhan T. Lam
*Attorney, Agent, or Firm*—Roger A. Marrs

[57] ABSTRACT

A portable infant products organizer comprising a flexible covering conforming in shape to an insert which is of rigid construction for insertion into a storage cavity of the covering and which may be removed from the cavity in order to visually observe the plurality of products carried on the insert. The insert includes a rigid bottom having upright supports for slidably accommodating at least a pair of panels. The outside surface of each panel includes a plurality of flexible clamps, studs, snaplock components or the like which are available for detachably receiving a multiplicity of infant care supplies or products. The storage insert further includes a central storage compartment separating the pair of panels for accommodating additional supplies such as towels, pads, etc. Handle members are provided on each of the respective panels so that the user may remove either one of the pair of panels from the insert while the insert is in the storage compartment of the covering.

10 Claims, 3 Drawing Sheets

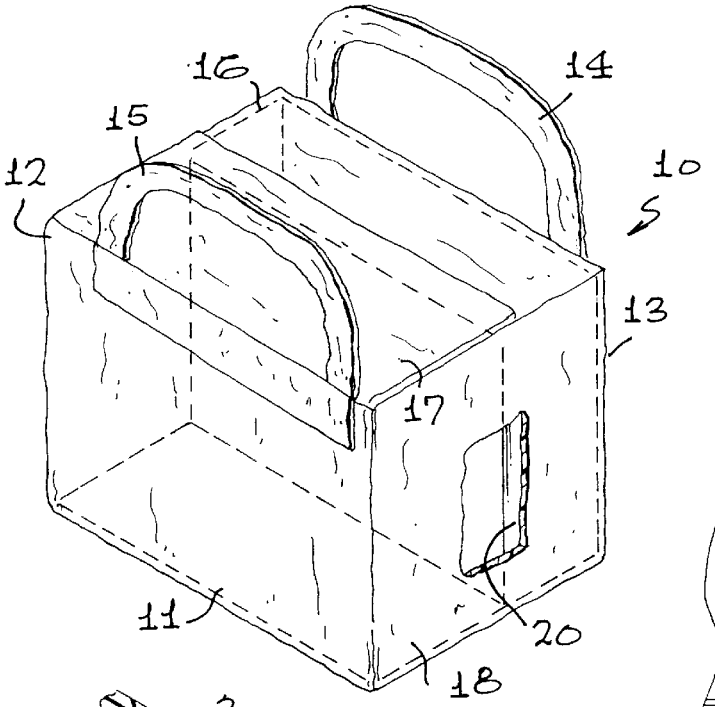
FIG. 1
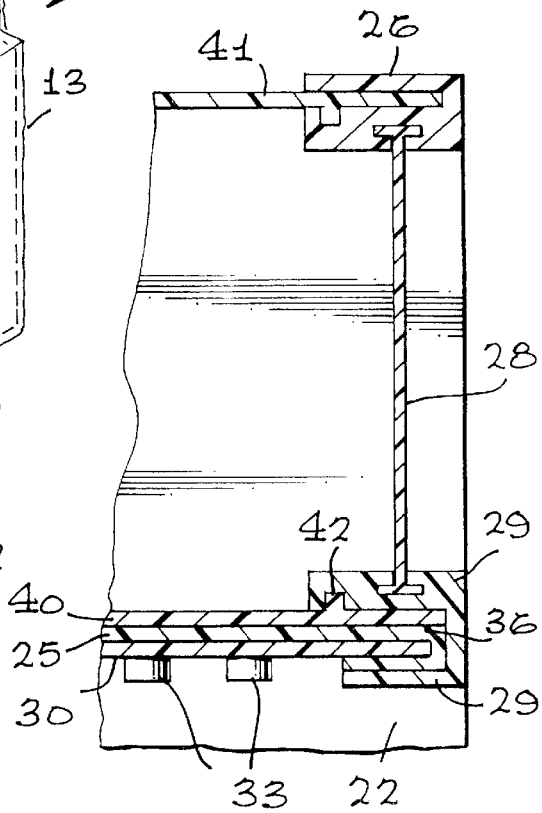
FIG. 3
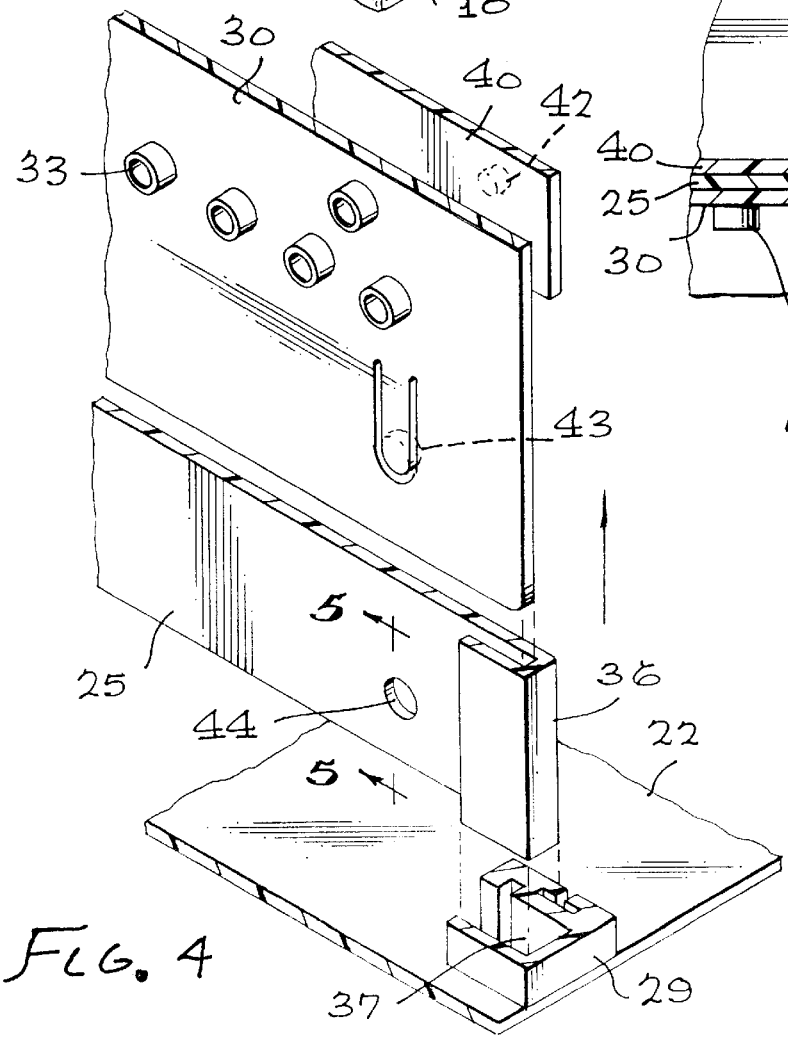
FIG. 4
FIG. 5
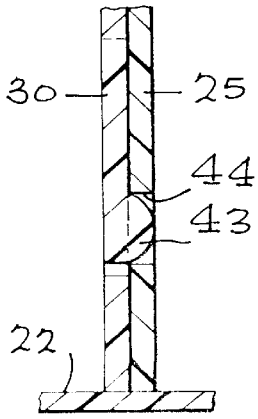

INFANT PRODUCTS ORGANIZER

Priority based on provisional application Ser. No. 60/069,408 filed Dec. 18, 1997.

BACKGROUND OF THE INVENTION

1. Field of the Invention

The present invention relates to the field of infant care apparatus, and more particularly to an infant care organizer for storing a plurality of baby and infant items, such as bottles, diapers, and other infant care supplies.

2. Brief Description of the Prior Art

Conventionally, a multiplicity of storage cases, containers and bags are known for carrying and storing infant care supplies. As an example, diaper bags are probably the most common of such devices and typically are fabric bags for storing both clean and soiled diapers, bottles, tissues, hand towels and the like. Some diaper bags have separate compartments for bottles while other diaper bags provide for storage of a changing pad.

Still another currently available container for transporting infant supplies resides in changing bags or the like having a small sack closable by a drawstring and having a number of external pockets. Spare disposable pads and liners are carried in the sack and ointments, talcum powder and other supplies can be fitted into the external pockets.

Although such prior containers, bags and sacks simplify the transportation of infant care supplies, such apparatus do not provide ready access to selected items and oftentimes mix the items which makes selection of a desired supply difficult to find. Furthermore, the provision for external pockets is greatly limited and only a reduced number of supplies can be carried in such pockets. In modern day infant care, a great many separate and individual care supplies and items are necessary and organization of such items and supplies in a carrier or container is greatly needed.

Some attempts have been made to provide a suitable portable carrying case for baby and infant care supplies such as disclosed in U.S. Pat. Nos. 5,062,557; 4,781,277 and 2,631,632. However, these disclosures are not pertinent since the apparatus relates to external storage pockets, maintenance of supplies in a cool environment and fully enclosed storage of supplies without provision for convenient visual selection and removal of stored product or supply.

Therefore, a long-standing need has existed to provide an infant or baby supply organizer which will hold the multiplicity of individual items and containers and which may be readily made visible for individual selection by the user when it is desired to remove one such item or container from the multiplicity. Also, from a sanitary and transportation consideration, external pockets are not preferred since items and supplies can inadvertently fall from such external storage.

SUMMARY OF THE INVENTION

Accordingly, the above problems and difficulties are avoided by the present invention which provides a novel portable baby or infant supply organizer comprising a flexible covering having the shape of an insert which is of rigid construction and may be readily introduced into a storage cavity within the covering and readily removed from the cavity in order to visually observe the plurality of supplies carried on the insert. The insert includes a rigid bottom having upright supports for slidably accommodating at least a pair of panels. The outside surface of each panel includes a plurality of flexible clamps, studs, snaplock components or the like which are available for detachably receiving a multiplicity of baby and infant care supplies. The storage insert further includes a central storage compartment separating the pair of panels for accommodating additional supplies such as towels, pads or the like. Handle means are provided on each of the respective panels so that the user may readily remove either one of the pair of panels from the insert while the insert is in the storage compartment of the covering.

The releasable or detachable mountings carried on the external surface of the panel may readily connect with any one one of the plurality of infant care supplies that may include supplies within containers of a cylindrical configuration, box-like configuration, or any other shape whether the supply container is composed of rigid material, such as metal or a soft material such as plastic. Containers for holding infant care supplies may be detachably connected to the snap-on lugs or studs carried on each of the respective panels and detent means are provided on each of the respective panels for releasably holding the panels to the upright frame carried on the insert base.

Therefore, it is among the primary objects of the present invention to provide a novel baby or infant care supply organizer in a manner whereby the user may readily observe the respective supplies and make a visual selection without disturbing or removing non-selected supplies.

Another object of the present invention is to provide a novel infant care supply organizer which provides a removable insert on which a plurality of care products are detachably stored whereby the insert is provided with a soft fabric cover so that the supplies are internally stored without the need for external pockets.

Still a further object is to provide a baby bag organizer which is adapted to operate as a baby diaper bag container to be used with any standard size open-top diaper bag.

Another object resides in providing a base adapted to be inserted into a covering and wherein the base includes at least two sliding side organizing panels on which a plurality of care supplies are releasably or detachably carried.

A further object resides in providing a baby or infant care supply organizer that includes a fabric container with an open cavity into which an insert is removably carried and on which a plurality of releasable and detachable fasteners are carried for holding the care supplies.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a perspective view of the novel infant care products organizer of the present invention illustrating the insert within the container covering and including handle means for carrying the assembly from place to place;

FIG. 3 is a fragmentary sectional view of the products insert shown in FIG. 2 as taken in the direction of arrows 3—3 thereof;

FIG. 4 is a fragmentary exploded view of the care products attachment board slidably related to the insert frame;

FIG. 5 is a transverse cross-sectional view of the frame shown in FIG. 4 as taken in the direction of arrows 5—5 thereof;

DESCRIPTION OF THE PREFERRED EMBODIMENT

Figure 2:
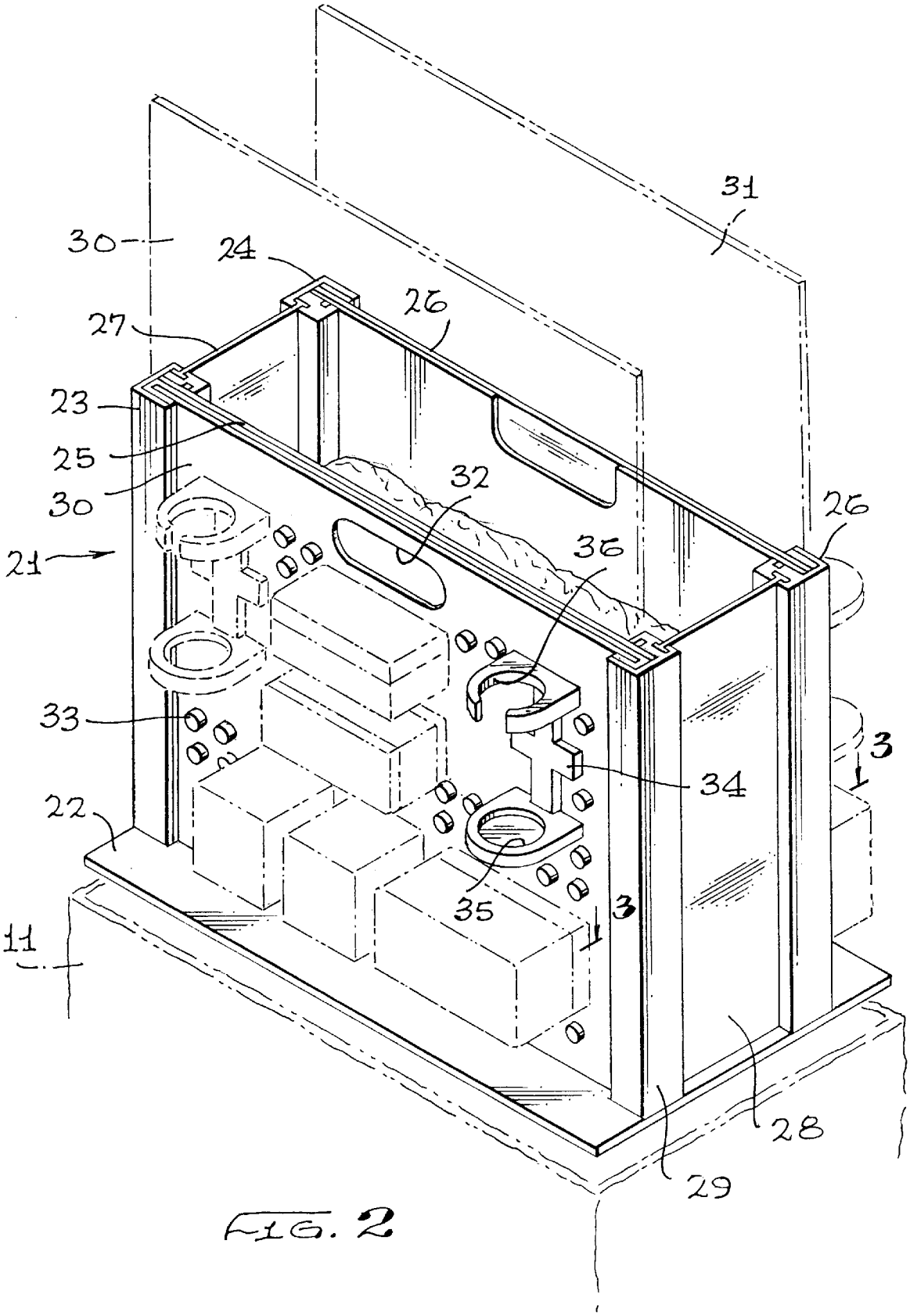
FIG. 2 is an enlarged perspective view of the inventive care products organizer shown in FIG. 1 illustrating the detachable care product retainers.

Referring to FIG. 1, the novel baby and infant care supply organizer is indicated in the general direction of arrow 10 which includes an exterior cover or container 11 which is preferably of a square of rectangular shape having a bottom two ends and two sides. The opposite sides, as indicated by numerals 12 and 13, are provided with handles 14 and 15 adapted to be hand-held by the user for transportation and carrying purposes. The cover 11 is composed of a pliable and soft fabric or other suitable material which serves to protect the interior storage compartment. The top of the cover or container 11 includes flaps 16 and 17 which may be used to cover an opening leading into the interior storage compartment. The ends of the container are illustrated and numeral 18 refers to one end which is broken away to expose the interior storage compartment. Also, the broken away portion illustrates that within the storage compartment, there is provided a framework broadly indicated by numeral 20. Therefore, when it is desired to open the container 11, the flaps 15 and 16 are folded over against the respective handles 14 and 15 and the interior frame 20 is exposed. The frame 20 forms a major portion of an insert which may be lifted out of the storage compartment and the insert includes means for carrying the infant care supplies in an organized and convenient manner.

Referring now in detail to FIG. 2, the removable insert is broadly indicated in the direction of arrow 21 and includes a base 22 adapted to rest against the bottom of the container 11 when the insert is within the internal storage compartment. The base 22 supports a frame consisting of upright posts or stanchions 23, 24, 25 and 26. The posts or stanchions support side members 25 and 26 as well as end members 27 and 28. The side and end members as well as the posts or stanchions provide a rigid framework which is carried on the base 22. In addition to supporting the end and side members, the posts are provided with slots so as to slidably capture the opposite ends of a pair of panels such as panel 30 and panel 31 carried on opposite sides of a framework in fixed spaced-apart relationship.

Referring to panels 30 and 31, it can be seen that the panels are in a raised position in broken lines and are in a storage position in solid lines. Either of the panels may be easily lifted from the frame by the user employing the handles formed in the top of each panel, such as handle 32. Each panel, such as panel 30, includes a supply holding or retaining means of external surface for releasably or detachably supporting a plurality of care products or supplies. For example, a plurality of snap-lock components, such as studs as represented by numeral 33, outwardly project from the surface in order to snap-lock in retaining engagement with any one of a plurality of holders. It is noted that the studs 33 are generally located in sets at different locations on the panel 30. Each set of studs is available for attachment with a selected one of a multiplicity of holders. For example, a bottle holder 34 may be suitably carried on studs so as to outwardly project. The holder includes a recessed base 35 for supporting a baby bottle while the upper part of the bottle can fit into a clamp 36. With respect to other infant care supplies, boxes and small containers may be snap-locked onto the studs and such additional containers are shown in broken lines.

Referring now in detail to FIG. 3, it can be seen that selected posts, such as posts 23 and 29, include a base from which a slotted member 36 is received in a receptacle 37. This is more clearly shown in FIG. 4. However, the slotted member 36 is integrally carried on the opposite ends of panel 25 and the member 36 is received within the openings 37 of the fitting 29. It can also be seen that the interior storage compartment of the insert 21 is defined by the opposite ends 27 and 28 as well as by sides 40 and 41. Therefore, the panels 40 and 41 may also be selectively raised from the framework without disturbing the panels 30 or 31, if desired. It is to be understood that the invention may include a single panel 30 or may include a pair of panels 30 and 31.

Referring to FIGS. 3 and 4, it can be seen that the panel 40 includes a pin 42 which is insertably received through a groove in the fixture 29. The pin and groove serve as a guide for raising and lowering the panels 40 and 41 individually or in unison. Also, it can be seen that the panels 30 and 31 include a resilient detent means 43 which includes a detent that is resiliently mounted so as to releasably engage with an opening or hole 44 in the wall 25. Thus, yieldable resistance is provided by the detent means to the raising and lowering of the panels 30 and 31 within the framework. FIG. 5 more clearly shows the detent action with respect to the opening 44 as a yieldable retainer.

Figure 6:
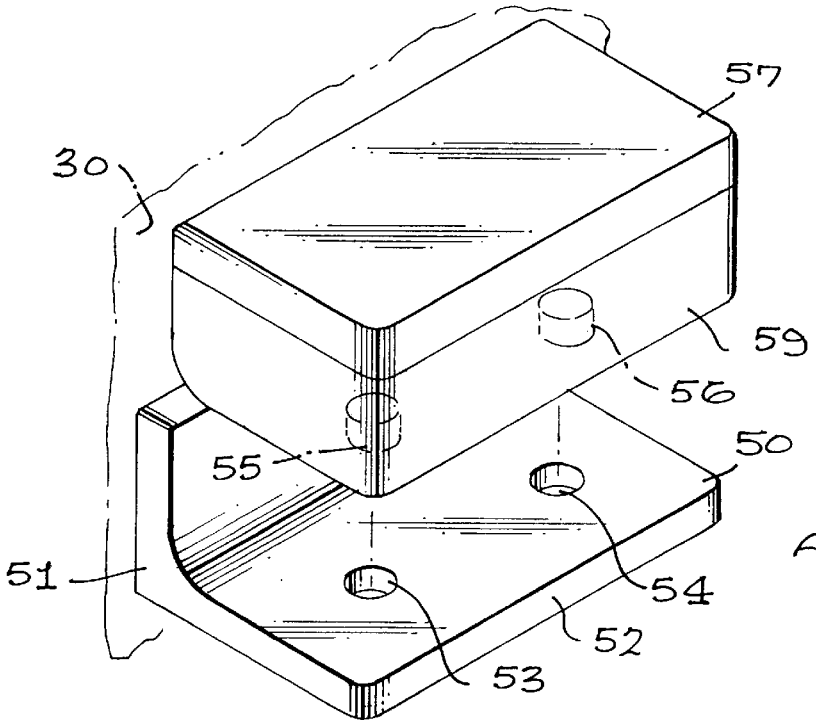
FIG. 6 is an exploded perspective view showing a container adapted to be snap-locked into the mountings carried on a panel of the insert.
Figure 7:
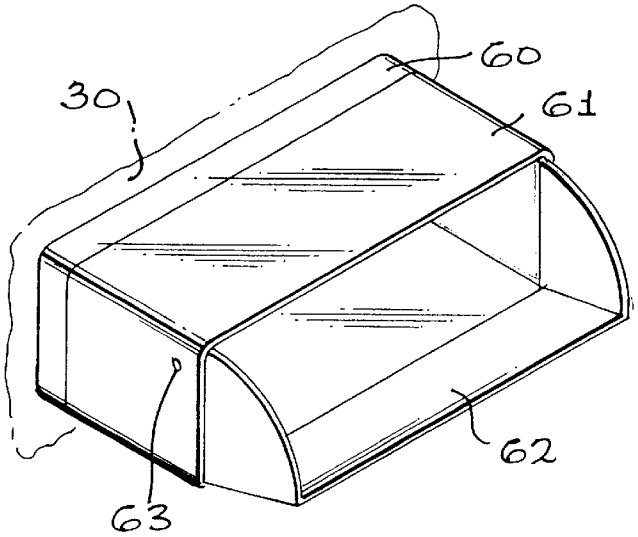
FIG. 7 is a perspective view of another container intended to be snap-locked onto the panel of the insert.
Figure 8:
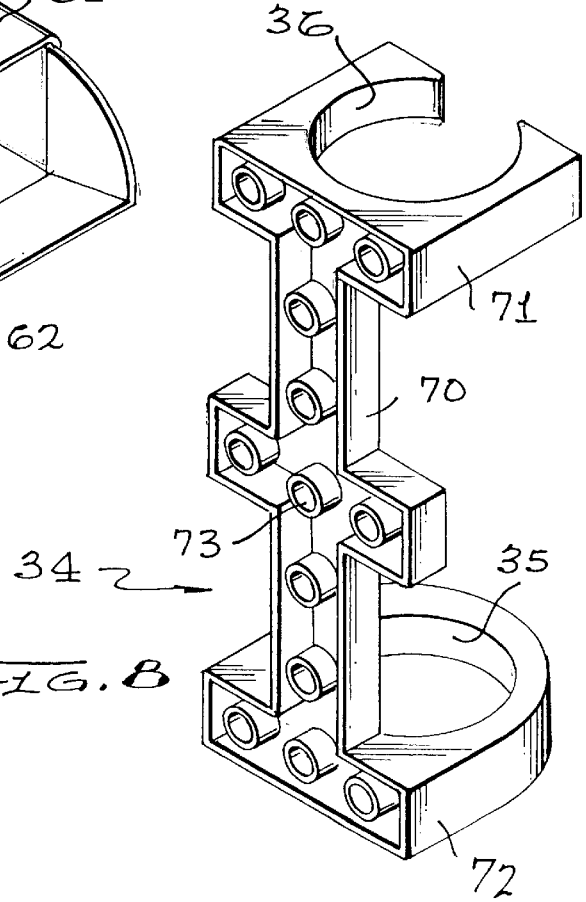
FIG. 8 is another version of a holder for snap-locking into position on an insert panel.

Referring to FIGS. 6, 7 and 8, a variety of containers and snap-on holders are illustrated. In FIG. 6, a shelf 50 may be mounted onto the front surface of panel 30 by means of snap-locking fasteners together, as previously described, utilizing the studs 33 as one component and mating studs on the back of the holder 50. The studs cooperate to snap-lock together in a conventional manner so as to support the shelf 50. The shelf includes a back wall 51 holding the studs matable with the studs 33 and further includes a forward facing shelf 52 which has a pair of spaced-apart holes 53 and 54 for insertably receiving downwardly depending projections 55 and 56 extending beneath a box-like holder 5. The holder includes a lid 57. Therefore, it can be seen that a box may be employed to hold any one of the plurality of infant care products or supplies and that the box is detachably mounted to the shelf 52. The shelf 50 may be detachably connected with the face of panel 30 by means of the snap-lock studs.

Referring now in detail to FIG. 7, another container is illustrated having a back wall 60 on which matable studs are provided for attachment to the studs 33 on the external face of panel 30. The wall 60 supports a box 61 having an opening front which is closed by a pivotal cover or lid 62. The lid is pivotally mounted by means of pivot arrangement 63 located on opposites sides of the lid or cover 62.

Referring to FIG. 8, a holder 34 is illustrated having an elongated midsection 70 which has a clamp-type member 71 integrally formed at one end and a base 72 formed at its opposite end. The base includes the previously described recess 35 while the upper portion or member 71 includes the clamp 36. It can be seen that a plurality of studs 73 are carred on the back side of the holder 34 and these studs include recesses operable to snap-lock with the studs 33 on the exterior surface of panel 30. The same kind of stud arrangements as shown in FIG. 8 are used on the walls 51 and 60 of the shelf and box shown in FIGS. 6 and 7.

In view of the foregoing, it can be seen that the baby or infant care supply organizer of the present invention provides a novel means for carrying a plurality of such items in a convenient and easily accessible arrangement. When it is desired to use any of the supplies, the user can withdraw either one or both of the two panels from the respective frame and can visually and manually select the items intended to be used. The items are carried in the respective holders and boxes as well as in the central compartment between the slidable panels. The entire assemblage of supplies, the frame and the insertable panels are carried within an enclosing soft cover including handles so that the assemblage can be carried from place to place.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A portable infant products organizer comprising:

a flexible cover having an internal storage compartment;

a product insert of rigid construction and of a given shape so to conform with said internal storage compartment;

said product insert adapted to be insertably received within said internal storage compartment;

said product insert further having a rigid bottom with a pair of spaced apart upright supports slidably accommodating at least a pair of panels in spaced apart relationship;

each of said panels having an exterior surface; and a plurality of product retaining holders carried on said exterior surface of said panels for releasably holding and supporting products of infant care and usage.

2. The product organizer defined in claim 1 wherein:

said product retaining holders include clamps, clips, studs, and snaplock components.

3. The product organizer defined in claim 2 wherein:

said flexible cover has a shape adapted to receive the shape and configuration of said product insert.

4. The product organizer defined in claim 3 wherein:

said flexible cover including an open top constituting an entrance into said internal storage compartment for insertably receiving said product insert.

5. The product organizer defined in claim 4 including:

handle means on each of said panels for independent removal of either one of said pair of panels from said product insert while said product insert is in said storage compartment.

6. The product organizer defined in claim 5 wherein:

each of said spaced apart upright supports having a central slot along its major length for slidably retaining said panels.

7. The product organizer defined in claim 6 wherein:

a storage area having an opening at its top and defined between said spaced apart panels.

8. A portable infant product organizer comprising:

a product insert with a flat, rigid bottom;

said product insert has a support means of rigid construction fixed to said bottom and upwardly projecting away from said bottom;

said product insert further having a pair of insert panels slidably supported on said support means in spaced apart relationship to define a storage cavity therebetween;

said insert panels having an exterior exposed surface and a plurality of separate and independent product holders fixed thereon; and a carrier comprised of flexible material and adapted to receive said product insert into an interior of said carrier for enclosing and protecting said panels and said holders.

9. The infant product organizer defined in claim 8 wherein:

a selected one of said holders are of a snap-lock type.

10. The infant product organizer defined in claim 9 wherein:

said support means includes at least four spaced apart upright stanchions, each stanchion having a slot for slidably receiving a panel edge marginal region.

* * * * *